US006312180B1

(12) United States Patent
Panda

(10) Patent No.: US 6,312,180 B1
(45) **Date of Patent: *Nov. 6, 2001**

(54) APPLICATOR FOR CORRECTION FLUID

(75) Inventor: Aparajit Panda, Westborough, MA (US)

(73) Assignee: The Gillette Company, Boston, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 71 days.

This patent is subject to a terminal disclaimer.

(21) Appl. No.: 09/065,008

(22) Filed: Apr. 23, 1998

(51) Int. Cl.[7] ..... A45D 33/00
(52) U.S. Cl. ..... 401/130; 401/126
(58) Field of Search ..... 401/122, 126, 401/130, 118, 121, 123, 124, 128

(56) References Cited

U.S. PATENT DOCUMENTS

| | | | | |
|---|---|---|---|---|
| D. 291,373 | * | 8/1987 | Korber | D19/51 X |
| D. 291,374 | * | 8/1987 | Korber | D19/51 X |
| D. 389,965 | * | 1/1998 | Saladino | D19/49 X |
| 720,051 | * | 2/1903 | Moss et al. | 15/143.1 |
| 933,938 | | 9/1909 | Windle et al. | 401/264 |
| 1,094,138 | * | 4/1914 | Feneley | 401/264 |
| 1,828,485 | | 10/1931 | Allen | 401/202 |
| 1,909,096 | * | 5/1933 | Cooney | 401/130 |
| 2,282,406 | | 5/1942 | Hollenbeck | 401/264 |
| 2,291,676 | * | 8/1942 | Baker | 401/130 |
| 2,314,539 | * | 3/1943 | Hollenbeck | 401/264 |
| 2,397,080 | * | 3/1946 | Baker | 401/130 |
| 2,409,933 | | 10/1946 | Fleisher et al. | 401/264 |
| 2,453,201 | | 11/1948 | Cushman | 401/207 |
| 2,481,803 | | 9/1949 | Weaver | 401/207 |
| 3,134,124 | * | 5/1964 | Horn | 15/244.1 |
| 3,262,461 | * | 7/1966 | Kambersky | 401/129 X |

(List continued on next page.)

FOREIGN PATENT DOCUMENTS

| | | | | |
|---|---|---|---|---|
| 3024-381 | | 6/1980 | (DE) . | |
| 3024381 | * | 1/1982 | (DE) | 132/320 |
| 3303-341 | | 8/1984 | (DE) . | |
| 0 053 573 | | 10/1981 | (EP) . | |
| 0 053 573 A1 | | 10/1981 | (EP) . | |
| 0 119 506 | | 2/1984 | (EP) . | |
| 641 045 | | 9/1927 | (FR) . | |
| 641045 | | 7/1928 | (FR) . | |
| 682638 | | 10/1929 | (FR) . | |
| 682638 | | 5/1930 | (FR) . | |
| 989064 | * | 9/1951 | (FR) | 401/122 |
| 989064 | | 9/1959 | (FR) . | |
| 1269178 | | 6/1960 | (FR) . | |
| 1269178 | | 7/1961 | (FR) . | |
| 18586 | | 8/1914 | (GB) . | |
| 775009 | | 5/1957 | (GB) . | |
| 907102 | | 10/1962 | (GB) . | |
| 2 169 562 | | 7/1986 | (GB) . | |
| 2 216 785 | | 10/1989 | (GB) . | |
| 2 231 490 | | 11/1990 | (GB) . | |
| 0102100 | | 4/1990 | (JP) . | |
| 2-102100 | | 4/1990 | (JP) . | |
| 9212863 | | 8/1992 | (WO) . | |
| WO 92/12863 | | 8/1992 | (WO) . | |
| WO 97/21554 | | 6/1997 | (WO) . | |

*Primary Examiner*—David J. Walczak
(74) *Attorney, Agent, or Firm*—Marshall, O'Toole, Gerstein, Murray & Borun

(57) ABSTRACT

An applicator for a correction fluid includes a stem, an applicator tip including foam, and a flexor within the foam portion. The applicator preferably has a flexibility of at least 0.0005 inch of deflection per gram of force.

17 Claims, 3 Drawing Sheets

U.S. PATENT DOCUMENTS

| | | | | |
|---|---|---|---|---|
| 3,554,657 | * | 1/1971 | Aston | 401/122 |
| 3,568,236 | * | 3/1971 | Aston | 15/244.1 |
| 3,684,389 | | 8/1972 | Eron et al. | 401/207 |
| 4,208,145 | | 6/1980 | Azuma | 401/196 |
| 4,496,258 | | 1/1985 | Tanaka et al. | 401/206 |
| 4,509,540 | * | 4/1985 | Inagaki | 132/320 |
| 4,627,454 | | 12/1986 | Dahm | 132/318 |
| 4,712,266 | | 12/1987 | Yamaki | 15/167.1 |
| 4,712,571 | | 12/1987 | Remz et al. | 132/320 |
| 4,747,419 | | 5/1988 | Flynn et al. | 132/73 |
| 4,749,618 | | 6/1988 | Kawaguchi et al. | 428/375 |
| 4,792,252 | | 12/1988 | Kremer et al. | 401/206 |
| 4,812,071 | | 3/1989 | Batra et al. | 401/264 |
| 4,813,463 | | 3/1989 | Lin | 141/351 |
| 4,824,271 | | 4/1989 | Nagahama et al. | 401/196 |
| 4,848,947 | | 7/1989 | Kremer et al. | 401/206 |
| 4,913,175 | | 4/1990 | Yokosuka et al. | 132/317 |
| 4,923,317 | | 5/1990 | Bishop et al. | 401/205 |
| 4,960,340 | | 10/1990 | Tamiya et al. | 401/186 |
| 4,984,923 | | 1/1991 | Ota | 401/279 |
| 5,001,803 | * | 3/1991 | Discko, Jr. | 604/1 X |
| 5,035,524 | | 7/1991 | Sakurai | 401/206 |
| 5,073,058 | | 12/1991 | Fukuoka et al. | 401/260 |
| 5,082,386 | | 1/1992 | Hironaka et al. | 401/206 |
| 5,096,322 | | 3/1992 | Shiga et al. | 401/199 |
| 5,199,976 | | 4/1993 | Yau et al. | 523/161 |
| 5,299,877 | | 4/1994 | Birden | 401/206 |
| 5,306,755 | | 4/1994 | Yau et al. | 524/296 |
| 5,387,046 | | 2/1995 | Danno | 401/260 |
| 5,411,345 | | 5/1995 | Ueji et al. | 401/206 |
| 5,480,250 | | 1/1996 | Birden | 401/199 |
| 5,716,150 | | 2/1998 | Gueret | 401/129 |
| 6,033,143 | * | 3/2000 | Gueret | 401/129 |

* cited by examiner

APPLICATOR FOR CORRECTION FLUID

BACKGROUND OF THE INVENTION

The invention relates to applicators for correction fluids.

Correction fluids are used for correcting handwritten, typewritten or photocopied markings on paper. Generally, correction fluids are applied to a paper surface in liquid form. After application, the fluids harden to a film which can effectively cover erroneous markings on the surface and can receive a corrected marking. Correction fluids typically contain a resin that provides the flexible film, and an opacifying pigment, usually titanium dioxide, dispersed in a liquid. The liquid may be water or an organic solvent.

Correction fluids are often supplied in a small container with an applicator brush attached to the cap through a stem. A user unscrews the cap from the container and withdraws the brush loaded with correction fluid. The user then contacts the erroneous marking with the brush, and correction fluid is transferred to the substrate to cover the marking.

SUMMARY OF THE INVENTION

The invention relates to an applicator that can be used to apply correction fluid. The applicator preferably includes a stem, an applicator tip including foam, and preferably a flexible material, i.e., a flexor, within the tip. The applicator is easy to use and preferably can be inserted into a correction fluid container in the same general manner as brush applicators. The applicator provides an even laydown of correction fluid on a substrate, resulting in good correction quality. The applicator has good durability and facilitates precise correction.

In one aspect, the invention relates to an applicator, including a stem and an applicator tip including foam, having a flexibility of at least 0.0005 inch of deflection per gram of force, preferably at least 0.002 inch of deflection per gram of force.

In another aspect, the invention features an applicator, including a stem and an applicator tip including foam, having an angled chisel-shaped application surface for applying correction fluid to a substrate.

In another aspect, the invention relates to a applicator including a stem and an applicator tip including a quenched foam. By quenched foam, it is meant a foam that is reticulated (substantially all membranes have been removed to make it open-celled) by chemical methods.

In another aspect, the invention relates to a applicator including a stem and an applicator tip including foam having an average pore size of between 20 ppi (pores per linear inch) and 130 ppi.

The invention further relates to correction fluid products including a body defining a reservoir and having an opening. The reservoir includes a correction fluid, and the applicator is inserted through the opening so that the portion is in contact with the correction fluid. Preferably, the product also includes an insert through the opening, through which the applicator passes during use. Preferred inserts include a narrowed neck portion that removes excess correction fluid when the applicator tip is withdrawn from the reservoir.

The invention further relates to an applicator having an applicator tip including foam, a correction fluid reservoir, including correction fluid, from which the correction fluid is fed to the applicator tip. The applicator has a flexibility of at least 0.0005 inch of deflection per gram of force. The applicator may also include a removable enclosure (e.g., a cap) for the tip.

Other features and advantages of the invention will be apparent from the description of the preferred embodiment thereof, and from the claims.

DESCRIPTION OF THE PREFERRED EMBODIMENTS

Figure 1:
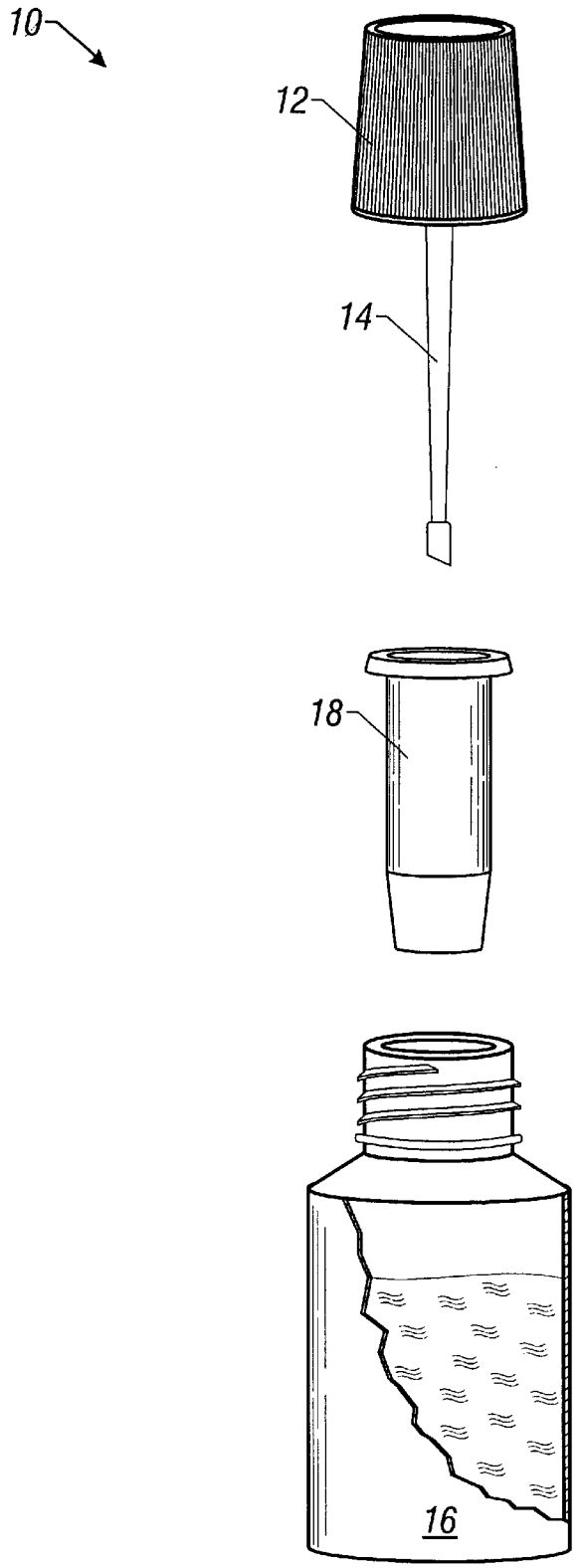
FIG. 1 is an exploded view of a correction fluid container including a correction fluid.
Figure 2:
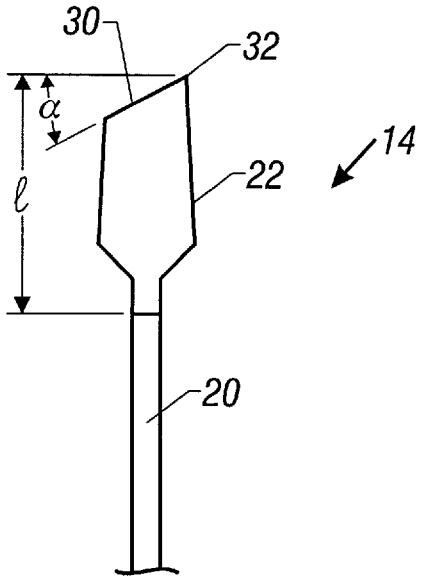
FIG. 2 is a side view of the end portion (including the applicator tip) of the foam applicator in FIG. 1.
Figure 3:
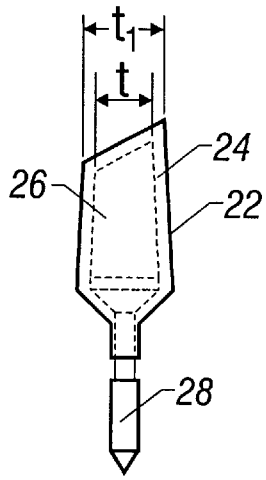
FIG. 3 is a side view of the applicator tip removed from the applicator in FIG. 2, with the portion of the flexor within the tip shown in broken lines.
Figure 4:
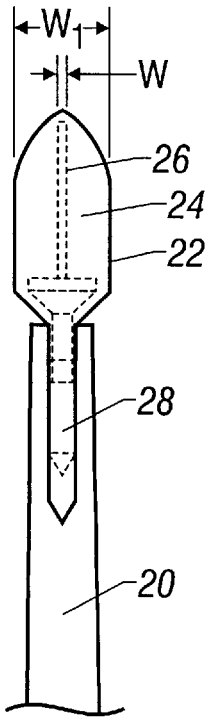
FIG. 4 is a front view of the end portion of the foam applicator tip in FIG. 3.

Referring to FIGS. 1–4, a correction fluid container 10 includes a cap 12, an applicator 14, a body 16 including a correction fluid reservoir, and an insert 18.

Applicator 14 includes a stem 20, and an applicator tip 22. The applicator tip includes a foam portion 24 enclosing a flexor 26. The applicator has a flexibility of at least 0.0005 inch of deflection per gram of force, preferably at least 0.002 inch of deflection per gram of force, measured as described below. The flexibility of the applicator depends on a number of factors, including the stiffness of the stem; the composition, length, width, and thickness of the flexor; and the chemical composition and thickness of the foam portion.

The stiffness of the stem depends on the composition, length, and diameter of the stem. Generally, the less stiff the stem, the more flexible the applicator. Stems composed of softer materials are less stiff than stems composed of harder materials, and longer stems are less stiff than shorter stems. Stems may be made of, for example, polymeric materials such as a low density and/or high density polyethylene or polypropylene. The stem may have a length, for example, of between 2 cm and 15 cm, and preferably between 2 cm and 10 cm. It also may have a diameter of between, for example, 0.1 cm and 2 cm, and preferably between 0.2 cm and 0.8 cm. Stem 20 has a length of 4.1 cm and a diameter of 0.31 cm.

Flexor 26 includes an extension 28 that fits into the hollow end of stem 20.

Generally, the softer the foam and the thinner the applicator tip the greater the flexibility of the foam applicator. The foam may be, for example, an open cell foam having a pore size, for example, of between 20 ppi and 130 ppi, preferably between 80 ppi and 120 ppi, and may be, for example, a polyether/polyurethane, polyester/polyurethane, polyether, or polyester foam. The foam can have a density, for example, in the range of 1.6 $lb/ft^3$ to 15.0 $lb/ft^3$, a compression deflection (CLD) of 25% R (radius) at (0.05–5.0) psi and a CLD of 65% at (0.2–10) psi. A preferred foam is a quenched polyester polyurethane foam having a density of 1.85 $lb/ft^3$, a pore size of 80 ppi to 120 ppi, a CLD of 25% R at 0.25 psi, and a CLD of 65% R at 0.45 psi.

The foam portion (including the enclosed flexor) may have a thickness ($t_1$), for example, of between 0.16 cm and 1.27 cm, a length (l) of between 0.3 cm and 2.0 cm, and a width (w) between 0.2 cm and 1.0 cm. Foam portion 24 has a thickness ($t_1$) (at midpoint) of about 0.44 cm, and a length (l) of about 0.9 cm. Foam portion 24 is tapered and has a thickness at its base of about 0.44 cm and a thickness towards its tip of about 0.34 cm.

Generally, the softer the composition of the flexor the greater the flexibility of the foam applicator. The flexor may be composed, for example, of a composite of linear low density polyethylene and a thermoplastic olefin having a very high softness and low modulus (e.g., Adflex KS-359P, available from Mobil), low density polyethylene, high density polyethylene, polypropylene, or nylon. In addition, as a general rule, thinner flexors provide more flexible foam applicators. The flexor may have, for example, a width (w) of between 0.02 cm and 0.15 cm, and a thickness (t) of between 0.1 cm and 1.0 cm. Flexor 26 has a width (w) of 0.06 cm. Flexor 26 is tapered but has a thickness of about 0.25 cm at its mid-point.

Foam applicator 14 has an angled chisel-shaped applicator surface 30 that includes a point 32. The angle ($\alpha$ in the Figure) preferably is between 15° and 60° (e.g., 30°). The long applicator side surface can be used to apply correction fluid over words; the point or straight edge of 32 allows a user to easily apply correction fluid to individual letters.

Insert 18 may be composed, for example, of a high density polyethylene. The insert has a narrowed neck region 30 that may have an inside diameter of between 3.0 mm and 5.0 mm (e.g., 3.8 mm), and may have a length of between 5 mm and 40 mm (e.g., 25 mm). When portion 24 is removed (wiped off) from the correction fluid reservoir for use, excess correction fluid is removed by narrowed neck 34. When portion 24 is reinserted into the fluid reservoir after use, any excess correction fluid that comes off portion 24 during reinsertion generally is accommodated by the portion of insert 18 above the narrowed neck, thus avoiding spillage of correction fluid.

Applicator 10 may be used with organic solvent-based or water-based correction fluids. In addition to the liquid vehicle, correction fluids may include an opacifying agent such as titanium dioxide, a film-forming polymer, and various other standard ingredients. Correction fluids may have a viscosity, for example, of between 10 cps and 2000 cps, preferably between 30 cps and 1000 cps, at 20 rpm using a Brookfield Viscometer. Preferred correction fluids are described in, for example, U.S. Pat. Nos. 5,199,976 and 5,306,755, which are incorporated by reference herein.

Figure 5:
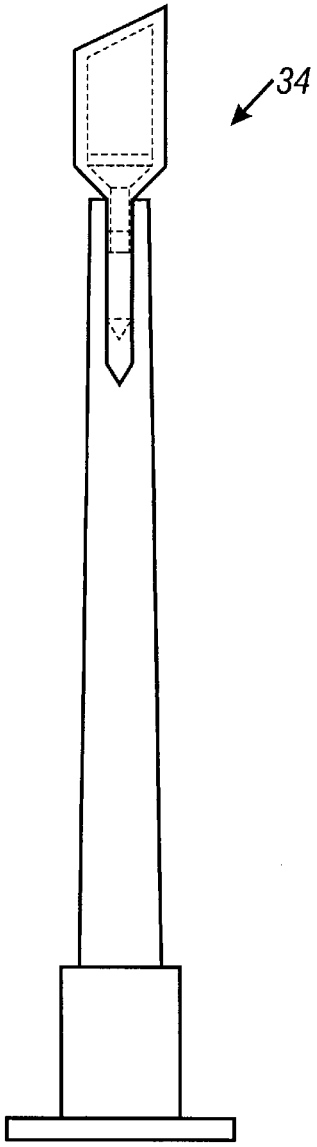
FIG. 5 is a side view of a second applicator, with the flexor shown in broken lines.

Referring to FIG. 5, an applicator 34 has a design similar to applicator 14. Applicator 34, unlike applicator 14, does not have a tapered foam portion or tapered flexor.

Figure 6:
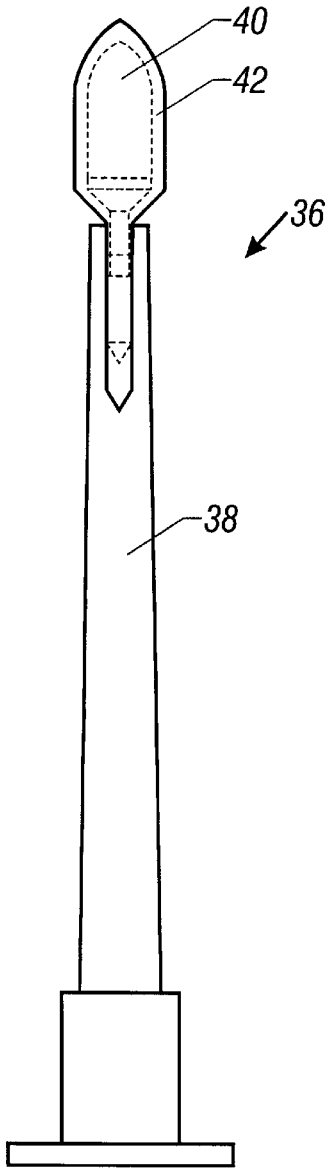
FIG. 6 is a side view of a third applicator, with the flexor shown in broken lines.
Figure 7:
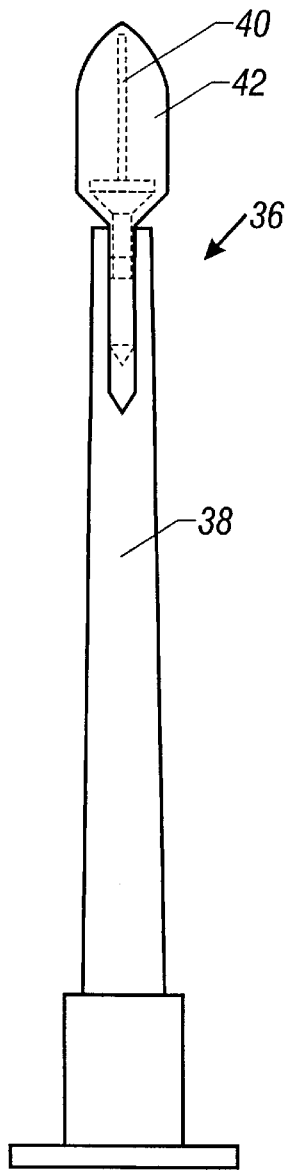
FIG. 7 is a rear view of the applicator in FIG. 6.

Referring to FIGS. 6 and 7, an alternative applicator 36 has a spear-shaped tip and includes a stem 38, a flexor 40, and a foam portion 42.

The flexibility of an applicator can be measured using an Instron Model 1122 Compression Tester. The capped end of the applicator is attached to a fixed stand, having a rotating fixture to vary the angle of attachment. The angle is set at 40° so that the foam-tip is just underneath the vertical cylinder (probe) of the tester, having a diameter of 15 cm. This probe is then moved downwards slowly at a controlled rate of 0.13 cm/min while pressing the foam-tip during its downward movement. The force generated by the probe to deflect the foam-tip and the actual deflection of the foam-tip were continually monitored and transmitted to a recorder for recording on a X-Y graph. The flexibility (calculated from the graph) corresponds to the ratio of deflection distance to the applied force, i.e., the slope of deflection vs. applied force graph. The measurements are conducted at various deflection distances, e.g., 0.05", 0.1", 0.15", 0.20" and 0.25".

The flexibility of 12 applicators was measured according to this procedure. The results are shown below in Tables 1 and 2. "Spear" in the applicator in FIGS. 6 and 7; "Chisel #1" is the applicator in FIGS. 1–4; and "Chisel #2"is the applicator in FIG. 5.

TABLE 1

| Applicator Tested | | | | |
|---|---|---|---|---|
| Design | Code | Flexor | Foam[2] | Stem |
| Spear | G | Polypropylene | 3/16" Zapped[3] | HDPE |
| Spear | Z | Polypropylene | 3/16" Ultra Fine[4] | HDPE |
| Chisel #1 | A | 100% LDPE | 3/16" Quenched[5] | LDPE |
| Chisel #1 | V | 100% Adflex[1] | 3/16" Quenched | LDPE |
| Chisel #1 | W | 75% Adflex/25% LLDPE | 3/16" Quenched | LDPE |
| Chisel #1 | X | 50% Adflex/50% LLDPE | 3/16" Quenched | LDPE |
| Chisel #2 | B | 100% Polypropylene | 3/16" Quenched | HDPE |
| Chisel #2 | C | 100% Adflex | 1/8" Quenched | HDPE |
| Chisel #2 | D | Natural Linear LDPE (LLDPE) | 1/8" Quenched | LDPE |
| Chisel #2 | E | 50% Adflex/50% LLDPE | 1/8" Quenched | HDPE |
| Chisel #2 | F | 50% Adflex/50% LLDPE | 1/8" Quenched | LDPE |
| Chisel #2 | Y | 50% Adflex/50% LLDPE | 3/16" Quenched | LDPE |

[1]Purchased from Montell Polyolefins.

[2]The number is the thickness and the type of foam.

[3]SIF ® Zapped (reticulated by thermal method), purchased from Foamex International of Eddystone, PA.

[4]SIF ® Ultra-Fine, a high density (6.0 lb/ft$^3$), fine pore (100–110 ppi) fully open cell polyester-polyurethane foam purchased from Foamex.

[5]SIF ® Quenched (reticulated by chemical method), available from Foamex.

TABLE 2

| Flexibility (inch of deflection per gram of force applied) | | | | | | | | | | | | |
|---|---|---|---|---|---|---|---|---|---|---|---|---|
| Deflection, Inches | A | B | C | D | E | F | G | V | W | X | Y | Z |
| 0.05 | 0.002776 | 0.002778 | 0.02 | 0.007143 | 0.005263 | 0.018182 | 0.001667 | 0.005 | 0.011111 | 0.005882 | 0.007143 | 0.001316 |
| 0.1 | 0.003571 | 0.001563 | 0.016667 | 0.005882 | 0.003333 | 0.014815 | 0.001802 | 0.007273 | 0.012903 | 0.005128 | 0.005128 | 0.001695 |
| 0.15 | 0.003846 | 0.001785 | 0.0125 | 0.006122 | 0.003614 | 0.012766 | 0.002 | 0.006522 | 0.013333 | 0.006 | 0.00625 | 0.001829 |

TABLE 2-continued

| | Flexibility (inch of deflection per gram of force applied) | | | | | | | | | | | |
|---|---|---|---|---|---|---|---|---|---|---|---|---|
| Deflection, Inches | A | B | C | D | E | F | G | V | W | X | Y | Z |
| 0.2 | 0.004167 | 0.001852 | 0.011765 | 0.006557 | 0.00354 | 0.011429 | 0.001869 | 0.005479 | 0.0125 | 0.006452 | 0.007018 | 0.001942 |
| 0.25 | 0.004587 | 0.001923 | 0.008065 | 0.00625 | 0.004237 | 0.008403 | 0.001437 | 0.004 | 0.006757 | 0.005051 | 0.007143 | 0.001429 |

Although the flexibility of the examples were measured at various deflection distances, "flexibility" (as that term is used in the claims) should be measured at a deflection distance of 0.05".

Other embodiments are within the claims.

What is claimed is:

1. A correction fluid product, comprising a body including a resorvoir and an opening, an applicator including a stem, and an applicator tip, mounted on said stem, comprising an open cell polyurethane/polyester foam, the applicator having a flexibility of at least 0.0005 inch of deflection per gram of force, and a cap, upon which said stem is mounted so that during storage of the product said stem extends through said opening into said reservoir and said cap seals said opening.

2. The product of claim 1 wherein the stem has a length between 2 cm and 15 cm.

3. The product of claim 1 wherein the foam comprises a quenched foam.

4. The product of claim 1 wherein the foam is stable to organic solvents.

5. The product of claim 1 wherein the applicator tip has an angled chisel-shaped edge.

6. The product of claim 1 wherein the applicator tip has an thickness of between 0.16 cm and 1.27 cm.

7. The product of claim 1 wherein the applicator tip further comprises a flexor within the foam.

8. The product of claim 1 wherein the correction fluid includes organic solvent.

9. The product of claim 1 wherein the correction fluid has a viscosity of between 10 cps and 2000 cps.

10. The product of claim 1 wherein the foam portion has an average pore size of between 20 ppi and 130 ppi.

11. The correction fluid product of claim 1, wherein said body comprises a reservoir-containing portion, and a neck portion having a relatively smaller diameter than said reservoir-containing portion.

12. The correction fluid product of claim 11 wherein said cap contacts an outer surface of said neck portion in threaded engagement.

13. The correction fluid product of claim 1 wherein said foam has a density of from about 1.6 $lb/ft^3$ to 15.0 $lb/ft^3$.

14. A method of applying a correction fluid to a paper surface to cover an ink marking using an applicator having a flexibility of at least 0.0005 inch of deflection per gram of force and including a stem and an applicator tip including an open cell polyurethane/polyester foam, comprising loading correction fluid onto the applicator tip, and contacting the paper surface with the applicator tip to transfer correction fluid over the ink marking.

15. The method of claim 14 wherein the applicator further includes a flexor within the foam.

16. The method of claim 14, wherein said applicator includes a cap, on which said stem is mounted, and a user holds the cap while contacting the paper surface.

17. The method of claim 14 wherein said foam has a density of from about 1.6 $lb/ft^3$ to 15.0 $lb/ft^3$.

* * * * *

UNITED STATES PATENT AND TRADEMARK OFFICE

CERTIFICATE OF CORRECTION

PATENT NO. : 6,312,180 B1
DATED : November 6, 2001
INVENTOR(S) : Panda et al.

It is certified that error appears in the above-identified patent and that said Letters Patent is hereby corrected as shown below:

Title page,
Item [75], Inventors' names should read -- Aparajit Panda and Kim Borelli-Sanborn --

Signed and Sealed this

Twenty-fourth Day of August, 2004

JON W. DUDAS
*Director of the United States Patent and Trademark Office*